US010818252B2

(12) United States Patent
Chen

(10) Patent No.: US 10,818,252 B2
(45) Date of Patent: Oct. 27, 2020

(54) LIQUID CRYSTAL DISPLAY DEVICE AND DRIVING METHOD OF LIQUID CRYSTAL DISPLAY PANEL

(71) Applicants: HKC CORPORATION LIMITED, Shenzhen, Guangdong (CN); CHONGQING HKC OPTOELECTRONICS TECHNOLOGY CO., LTD., Chongqing (CN)

(72) Inventor: Yu-Jen Chen, Chongqing (CN)

(73) Assignees: HKC Corporation Limited, Shenzhen, Guangdong (CN); Chongqing HKC Optoelectronics Co., Ltd., Chongqing (CN)

( * ) Notice: Subject to any disclaimer, the term of this patent is extended or adjusted under 35 U.S.C. 154(b) by 0 days.

(21) Appl. No.: 16/471,624

(22) PCT Filed: Dec. 16, 2017

(86) PCT No.: PCT/CN2017/116709
§ 371 (c)(1),
(2) Date: Jun. 20, 2019

(87) PCT Pub. No.: WO2018/113613
PCT Pub. Date: Jun. 28, 2018

(65) Prior Publication Data

US 2019/0325831 A1 Oct. 24, 2019

(30) Foreign Application Priority Data

Dec. 20, 2016 (CN) ..... 2016 1 1188394

(51) Int. Cl.
*G09G 3/36* (2006.01)
*G09G 5/06* (2006.01)

(52) U.S. Cl.
CPC ..... *G09G 3/3607* (2013.01); *G09G 3/3611* (2013.01); *G09G 5/06* (2013.01);
(Continued)

(58) Field of Classification Search
None
See application file for complete search history.

(56) References Cited

U.S. PATENT DOCUMENTS 6,493,112 B1 12/2002 Arce et al.

FOREIGN PATENT DOCUMENTS

CN 101009083 A 8/2007
CN 103257494 A 8/2013
(Continued)

OTHER PUBLICATIONS

International Search Report, dated Mar. 20, 2018, for HKC Corporation Limited et al., International Application No. PCT/CN2017/116709, Filed Dec. 16, 2017.
(Continued)

*Primary Examiner* — Aneeta Yodichkas
(74) *Attorney, Agent, or Firm* — Law Offices of Albert Wai-Kit Chan, PLLC

(57) ABSTRACT

The present disclosure discloses a driving method of liquid crystal display panel which includes: dividing the pixels of the liquid crystal display panel into multiple pixel groups; each pixel group includes an even number of pixels matrix arranged; obtaining an average grayscale value of the blue sub-pixels of each sub-pixel group based on an image input signal; obtaining two sets of target grayscale value pairs based on the average grayscale value; each set of target grayscale value pairs includes a high and low grayscale value; the front viewing angle brightness of the high and low grayscale value is identical with that of the average grayscale value; obtaining the corresponding two sets of driving
(Continued)

voltage pairs; and, driving the blue sub-pixels in the corresponding pixel group according to the two sets of driving voltage pairs. The present disclosure further discloses a liquid crystal display device.

20 Claims, 7 Drawing Sheets

(52) U.S. Cl.
CPC ..... *G09G 2300/0439* (2013.01); *G09G 2300/0452* (2013.01); *G09G 2320/028* (2013.01); *G09G 2320/0242* (2013.01); *G09G 2320/04* (2013.01)

(56) References Cited

FOREIGN PATENT DOCUMENTS

| | | | |
|---|---|---|---|
| CN | 103529614 | A | 1/2014 |
| CN | 104835468 | A | 8/2015 |
| CN | 106782371 | A | 5/2017 |

OTHER PUBLICATIONS

Written Opinion of the International Search Authority, dated Mar. 20, 2018, for HKC Corporation Limited et al., International Application No. PCT/CN2017/116709, Filed Dec. 16, 2017.

LIQUID CRYSTAL DISPLAY DEVICE AND DRIVING METHOD OF LIQUID CRYSTAL DISPLAY PANEL

TECHNICAL FIELD

The present disclosure relates to the field of liquid crystal display technology, and more particularly to a liquid crystal display device and a driving method of liquid crystal display panel thereof.

BACKGROUND

Typical large-size liquid crystal display devices mostly make use of negative VA liquid crystal or IPS liquid crystal technology. With regards to VA mode liquid crystal driver, brightness becomes saturated rapidly along with the driving voltage at a large viewing angle, which leads to serious viewing angle color shift, and further affects the image quality. Since the brightness of the blue sub-pixels in a side view increases along with the grayscale, the trend of brightness saturation is more significant and faster than that of the red sub-pixels and the green sub-pixels, which makes the image quality presents an obvious defect of leaning towards blue in a mixed-color viewing angle.

SUMMARY

Based on it, it is necessary to provide a liquid crystal display device and a driving method of liquid crystal display panel thereof capable of improving the problem of viewing angle color shift.

A driving method of liquid crystal display panel, includes: dividing the pixels of the liquid crystal display panel into multiple pixel groups; each pixel group including an even number of pixels matrix arranged; obtaining an average grayscale value of the blue sub-pixels of each sub-pixel group based on an image input signal; obtaining two sets of target grayscale value pairs based on the average grayscale value; each set of target grayscale value pairs includes a high and low grayscale value; the front viewing angle brightness of the high and low grayscale value is identical with that of the average grayscale value; obtaining the corresponding two sets of driving voltage pairs according to the two sets of target grayscale value pairs in each pixel group; and, driving the blue sub-pixels in the corresponding pixel group according to the two sets of driving voltage pairs.

In the above driving method of liquid crystal display panel, two sets of target grayscale value pairs are obtained based on the average grayscale value of each pixel group on the liquid crystal display panel. Each set of target grayscale value pairs includes a high and low grayscale value; and the front viewing angle brightness of the mixed two is identical with that of the average grayscale value, so that the brightness would not be affected. The corresponding two sets of driving voltage pairs are obtained according to the two sets of target grayscale value pairs, so that there are two sets of driving voltage pairs for improving the viewing angle color shift in each pixel group. Since different driving voltages have different effects to different grayscale value ranges on improving the viewing angle color shift, so that after mixing, from the low grayscale value to the high grayscale value, the change of the brightness of the blue sub-pixels along with the grayscale values could be close to the effect in the front viewing angle, effectively improving the defect of color shift caused by premature saturation of the blue sub-pixels at the large viewing angle.

In one embodiment, in the step of obtaining two sets of target grayscale value pairs based on the average grayscale value, the two sets of target grayscale value pairs are obtained by searching from a grayscale value lookup table; each grayscale value in the grayscale value lookup table corresponds to two sets of target grayscale value pairs.

In one embodiment, the step of obtaining two sets of target grayscale value pairs based on the average grayscale value includes: determining a grayscale range to which the average grayscale value of the blue sub-pixels in each pixel group belongs; obtaining the corresponding grayscale value lookup table according to the grayscale range of each pixel group; and, obtaining the corresponding two sets of target grayscale value pairs through utilizing the corresponding grayscale value lookup table, based on the average grayscale value of the blue sub-pixels in each pixel group.

In one embodiment, the method further includes a step of pre-storing the grayscale value lookup table.

In one embodiment, in the step of driving the blue sub-pixels in the corresponding pixel group according to the two sets of driving voltage pairs, one of the driving voltages of two adjacent blue sub-pixels is high and the other is low.

A liquid crystal display device includes a backlight component, further includes: a liquid crystal display panel, on which the pixels are divided into multiple pixel groups; each pixel group including an even number of pixels matrix arranged; a control component, including a computing unit and an obtaining unit; the computing unit being configured to receive an image input signal, and obtain an average grayscale value of the blue sub-pixels of each sub-pixel group based on the image input signal; the computing unit further being configured to obtain two sets of target grayscale value pairs based on the average grayscale value; each set of target grayscale value pairs includes a high and low grayscale value; the front viewing angle brightness of the high and low grayscale value is identical with that of the average grayscale value; the obtaining unit being configured to obtain corresponding two sets of driving voltage pairs according to the two sets of target grayscale value pairs in each pixel group; and a driving component, respectively connected to the control component and the liquid crystal display panel; the driving component being configured to drive the blue sub-pixels in the corresponding pixel group according to the two sets of driving voltage pairs.

In one embodiment, the obtaining unit is configured to obtain corresponding two sets of target grayscale value pairs by searching from a grayscale value lookup table based on the average grayscale value; each grayscale value in the grayscale value lookup table corresponds to two sets of target grayscale value pairs.

In one embodiment, the control component further includes a determining unit; the determining unit is configured to determine a grayscale range to which the average grayscale value of the blue sub-pixels in each pixel group belongs; the obtaining unit is configured to obtain the corresponding grayscale value lookup table according to the grayscale range of each pixel group, and obtain the corresponding two sets of target grayscale value pairs through utilizing the corresponding grayscale value lookup table, based on the average grayscale value of the blue sub-pixels in each pixel group.

In one embodiment, the device further includes a storage component, which is configured to store the grayscale value lookup table.

In one embodiment, when the driving component drives the blue sub-pixels in the corresponding pixel group according to the two sets of driving voltage pairs, one of the driving voltages of two adjacent blue sub-pixels is controlled to be high and the other to be low.

BRIEF DESCRIPTION OF THE ACCOMPANYING DRAWINGS

Figure 5:
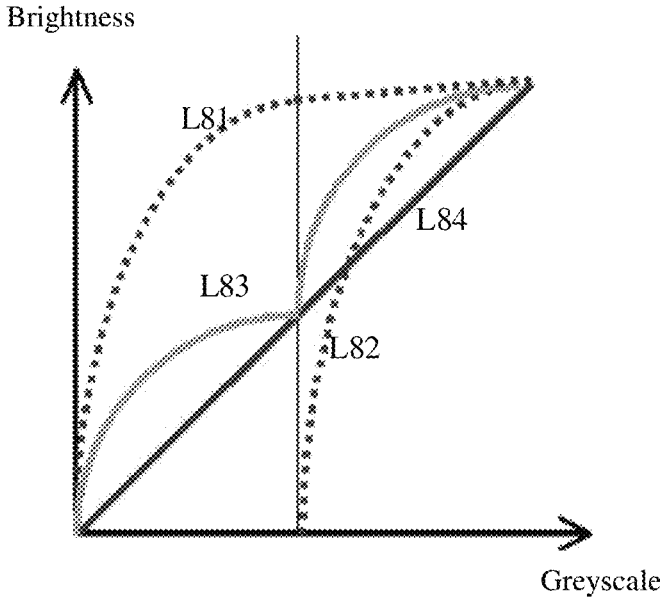
Figure 6:
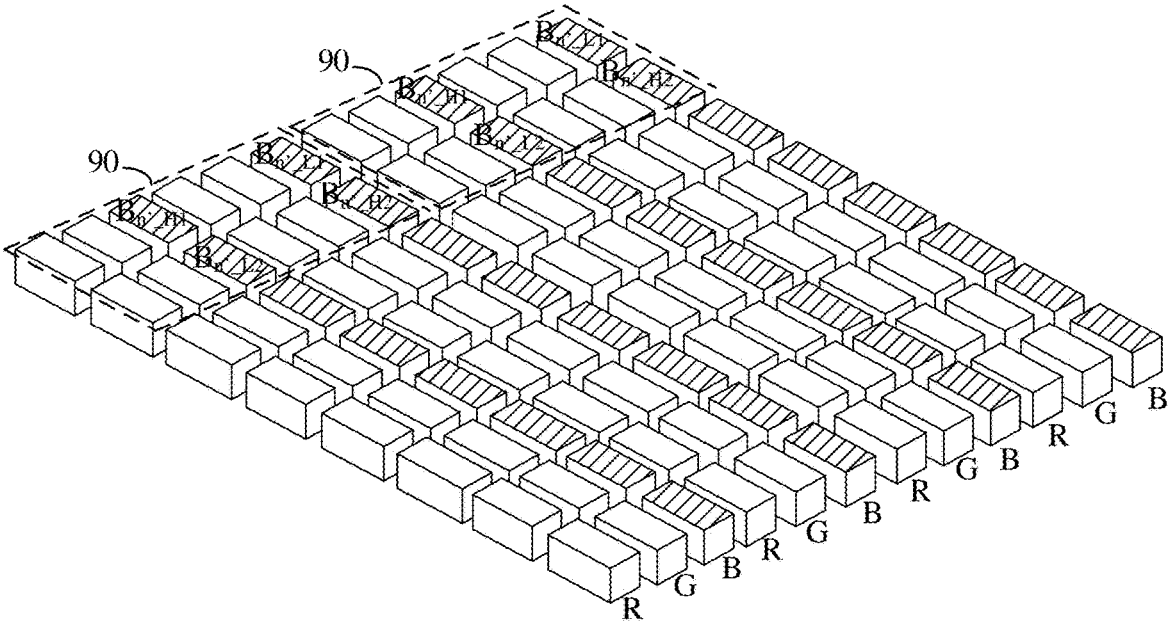
Figure 7:
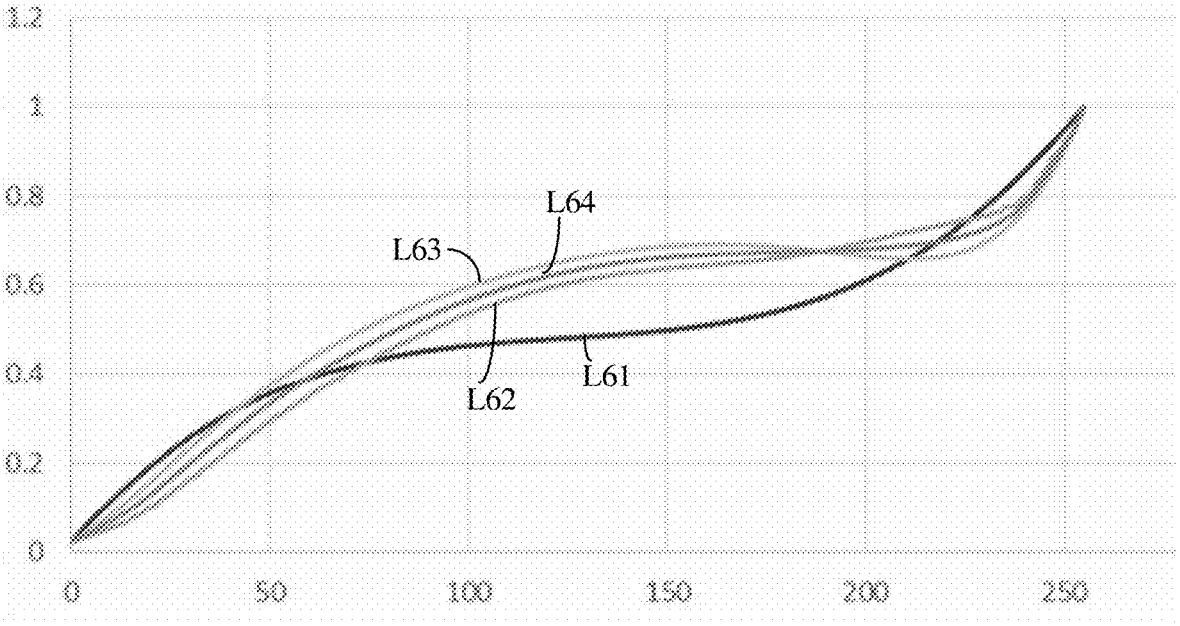

FIG. 5 a diagram illustrating the curves of brightness changing along with grayscale of the blue sub-pixels at a side viewing angle when driven by a high driving voltage, a low driving voltage, and a alternating high and low driving voltage;

FIG. 6 is a schematic diagram illustrating driving after executing S150;

FIG. 7 is a comparison diagram illustrating the curves of ideal brightness changing along with grayscale and each of brightness changing along with grayscale under two voltage combinations.

Figure 8:
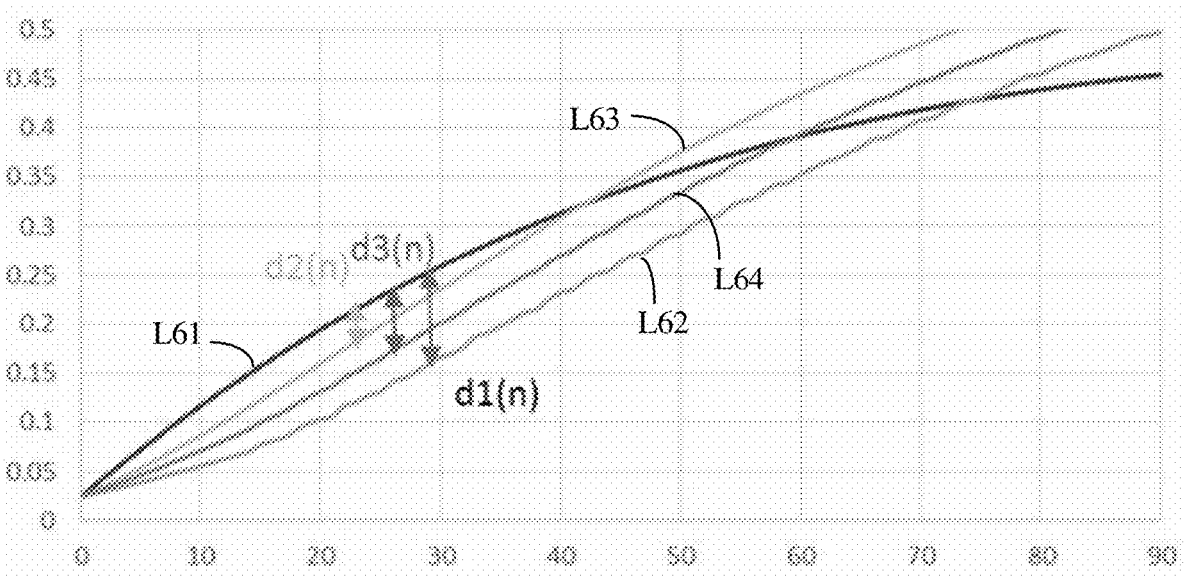
Figure 9:
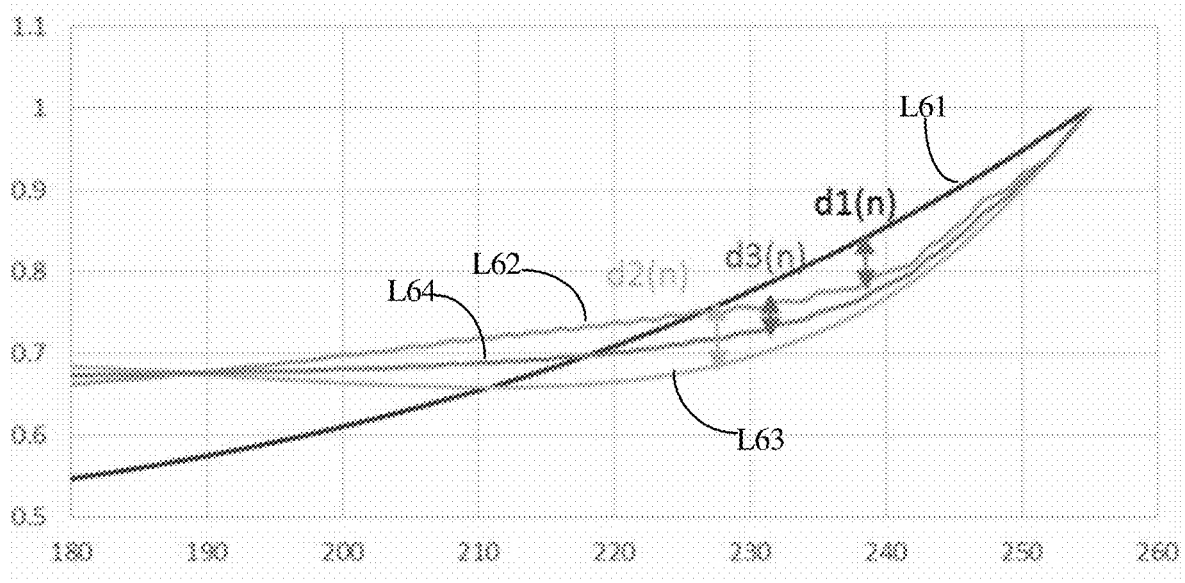
Figure 10:
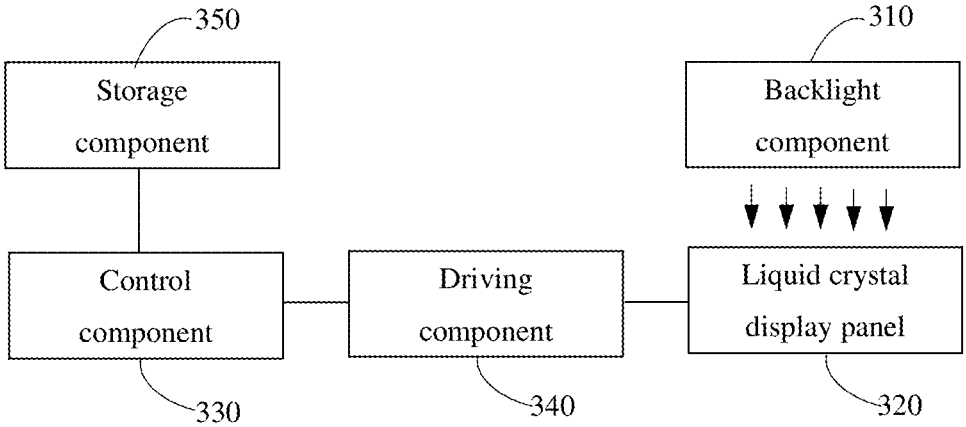
Figure 11:
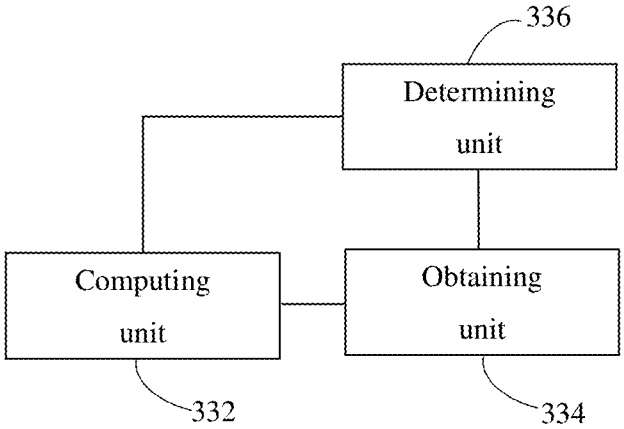
Figure 12:
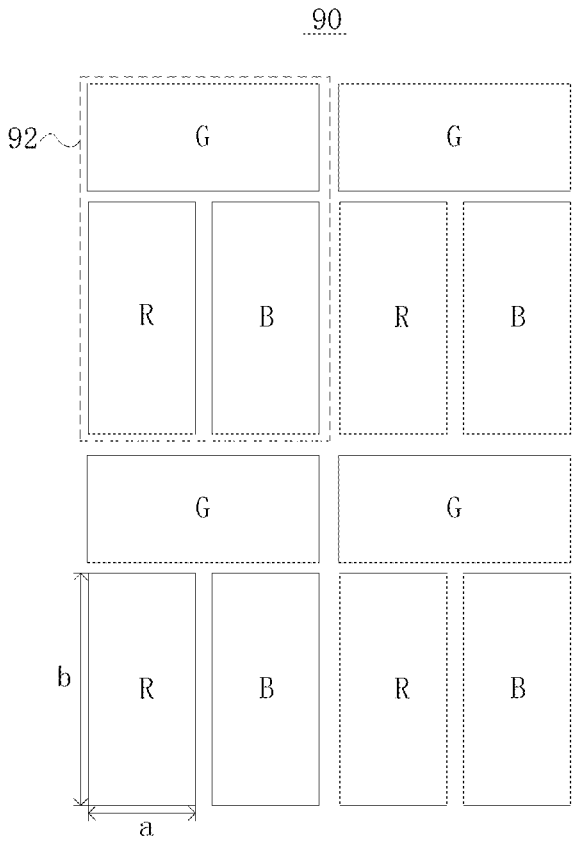

FIG. 8 and FIG. 9 are partial enlarged views of FIG. 7;

FIG. 10 is a block diagram illustrating an embodiment of the structure of a liquid crystal display device;

FIG. 11 is a block diagram illustrating an embodiment of the structure of a control component;

FIG. 12 is a schematic diagram illustrating a pixel group in another embodiment.

DETAILED DESCRIPTION OF ILLUSTRATIVE EMBODIMENTS

In order to make the aims, technical solutions and advantages of the present disclosure more clear, the present disclosure will be further described in detail below with reference to the drawings and embodiments. It is to be understood that, the specific embodiments described herein portrays merely some illustrative embodiments of the present disclosure, and are not intended to limit the patentable scope of the present disclosure.

Figure 1:
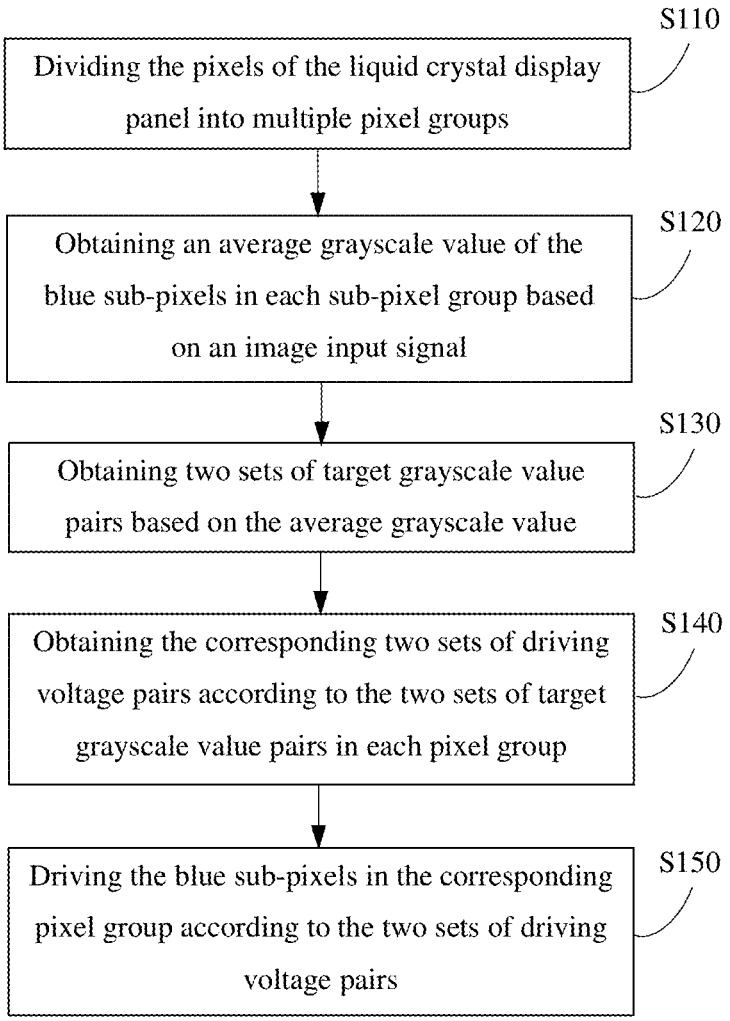
FIG. 1 is a flowchart illustrating an embodiment of a driving method of liquid crystal display panel according to the present disclosure.

FIG. 1 is a flowchart illustrating an embodiment of a driving method of liquid crystal display panel. The driving method of liquid crystal display panel can improve the defect of color shift (or chromatic aberration) caused by the mismatch of refractive index of the liquid crystal at a large viewing angle. In particular, it is capable of effectively improving the defect of color shift caused by premature saturation of the blue sub-pixels at the large viewing angle. The liquid crystal display panel may be a TN, OCB, VA mode liquid crystal display panel or a curved liquid crystal display panel, but is not limited thereto.

Referring to FIG. 1, the driving method includes the following steps:

S110, dividing the pixels of the liquid crystal display panel into multiple pixel groups.

Figure 2:
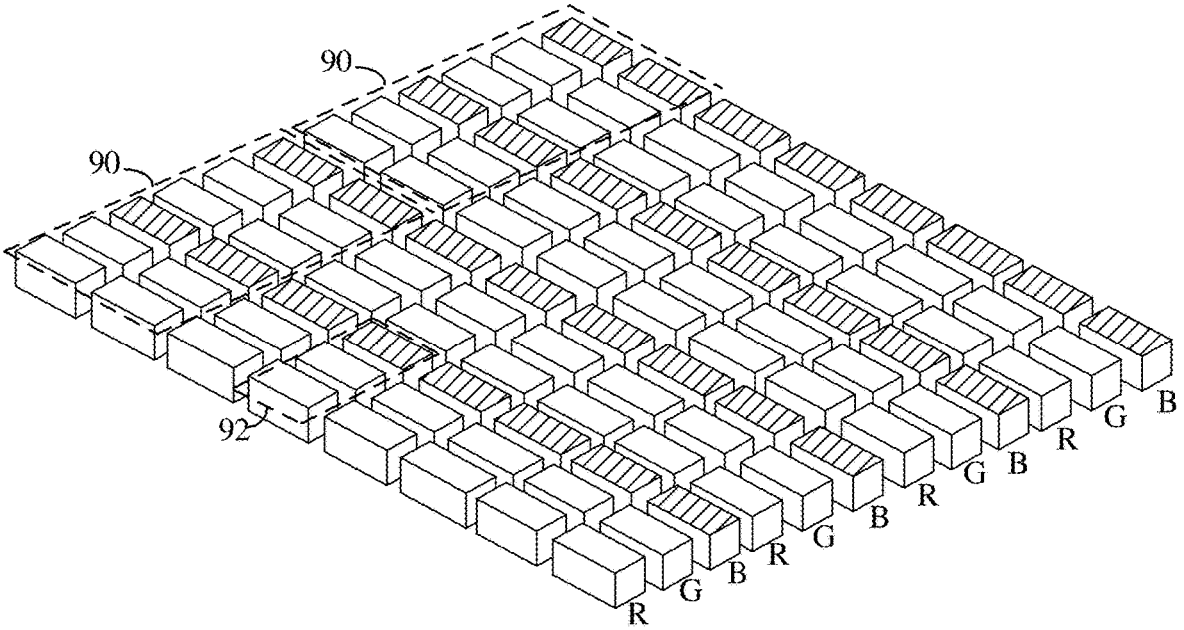
FIG. 2 is a schematic diagram illustrating pixel division after executing S110 in FIG. 1.

After dividing, each pixel group includes an even number of pixels matrix arranged. In this embodiment, each pixel group 90 includes four pixels matrix arranged after dividing, as shown in FIG. 2. Each of the pixels 92 includes a red sub-pixel R, a green sub-pixel G, and a blue sub-pixel B, that is, each pixel group 90 includes four blue sub-pixels matrix arranged. In another embodiment, the number of pixels included in each pixel group could be set as needed.

S120, obtaining an average grayscale value of the blue sub-pixels of each sub-pixel group based on an image input signal.

The grayscale value of each blue sub-pixel is represented by Bi, j. Wherein B represents blue, and (i, j) represents the sequential number of the blue sub-pixel in the entire liquid crystal display panel. The average grayscale value B'n of the blue sub-pixels in each sub-pixel group is calculated as follows:

$$B'n=\text{Average}(B_{i,j}+B_{i+1,j}+B_{i,j+1}+B_{i+1,j+1}).$$

S130, obtaining two sets of target grayscale value pairs based on the average grayscale value of each pixel group.

Each set of target grayscale value pairs includes a high and low grayscale value. The high and low grayscale value need to satisfy that the front viewing angle brightness after mixing the high and low grayscale value is identical with that of the average grayscale value B'n. Optionally, the brightness at the large viewing angle corresponding to the high and low grayscale value is as close as possible to the brightness of the average grayscale value at the front viewing angle. In one embodiment, the difference between the high and low grayscale value in the target grayscale value pairs needs to be greater than a preset difference range, thereby ensuring two grayscale values in the target grayscale value pairs have a relatively large grayscale difference. The two sets of target grayscale value pairs have different improving ranges on viewing angle color shift, the improving range of one set on viewing angle color shift is lower than that of the other, that is, one set is able to have a better effect on improving color shift for the high greyscale value at the large viewing angle, while the other set is able to have a better effect on improving color shift for the low greyscale value at the large viewing angle. In this embodiment, the high grayscale value is relative to the low grayscale value of the other set. The large viewing angle could be defined as greater than 60° or customized according to a user. The acquisition of the target grayscale value pairs can be performed by searching from a grayscale value lookup table (LUT). Specifically, each grayscale value in the grayscale value lookup table corresponds to two sets of target grayscale value pairs. The grayscale value lookup table in one embodiment is shown as following:

| Input grayscale | The 1st set of target grayscale value pairs | | The 2nd set of target grayscale value pairs | |
|---|---|---|---|---|
| value | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

The above grayscale value lookup table is merely an example and does not constitute a limitation on a specific grayscale value lookup table. The color shift improvement ranges of the two sets of target grayscale value pairs in each grayscale value lookup table do not overlap as much as possible, thereby ensuring from the low grayscale value to the high grayscale value, the brightness change of the blue sub-pixels along with the greyscale value can be close to the effect in the front viewing angle, effectively improving the defect of color shift caused by premature saturation of the blue sub-pixels at the large viewing angle. The grayscale value lookup table can be pre-stored in a storage component. Therefore, the corresponding two sets of target grayscale value pairs can be obtained according to the average grayscale value.

Figure 3:
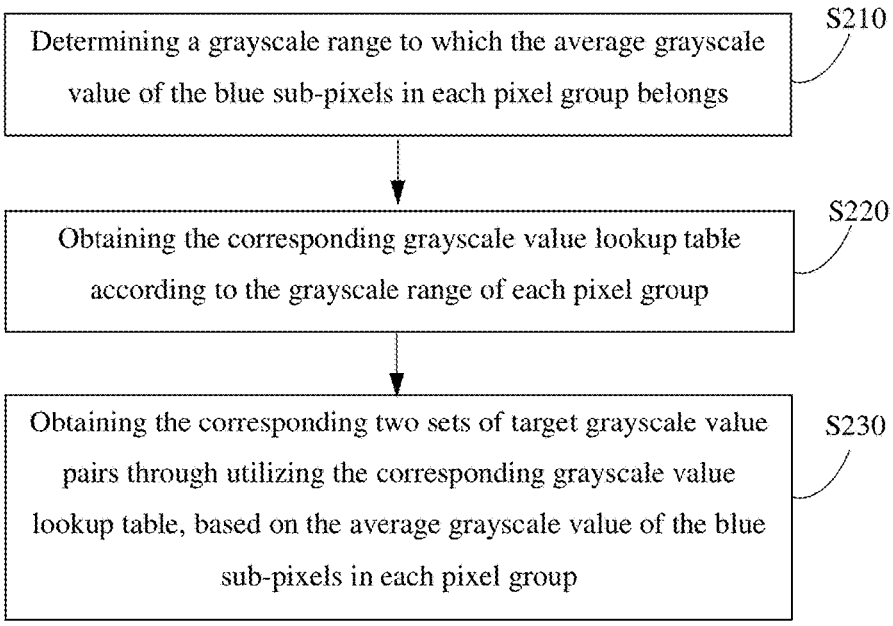
FIG. 3 is a detailed flowchart illustrating S130 in FIG. 1.

In one embodiment, the acquisition process of the target grayscale value pairs includes the following steps, as shown in FIG. 3.

S210, determining a grayscale range to which the average grayscale value of the blue sub-pixels in each pixel group belongs.

Before determining the grayscale range to which the average grayscale value belongs, the grayscale value of the blue sub-pixels is divided into a preset number of grayscale ranges, such as 0-50, 51-101, 102-152, 153-203, and 204 to 255. It can be understood that the grayscale ranges could be divided according to actual needs, and are not limited thereto. Each grayscale range could be determined by the desired degree to which the color shift is improved. Different grayscale range divisions are also pre-stored in the storage component so that they could be directly searched to be obtained.

S220, obtaining the corresponding grayscale value lookup table according to the grayscale range of each pixel group.

Different grayscale ranges have different effects on the viewing angle color shift, thus different grayscale ranges correspond to different grayscale value lookup tables, so that correspond to different grayscale values and could obtain the target grayscale value pairs more suitable to the grayscale ranges, the target grayscale value pairs corresponds to the driving voltages, that is, through more suitable driving voltages to perform driving, thus ensuring the brightness of the blue sub-pixels after adjusting at the side viewing angle changing along with greyscale is closer to the changing curve at the front viewing angle. The correspondence table between the grayscale value ranges and the grayscale value lookup tables may be pre-stored in the storage component in advance, therefore the corresponding driving voltage can be determined according to the obtained grayscale range.

For example, when the average grayscale value belongs to 0~50, the grayscale value lookup table LUT1 is used, as shown in the following table:

| Input grayscale | The 1st set of target grayscale value pairs | | The 2nd set of target grayscale value pairs | |
|---|---|---|---|---|
| value | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

When the average grayscale value belongs to 51~100, the grayscale value lookup table LUT2 is used, as shown in the following table:

| Input average | The 3rd set of target grayscale value pairs | | The 4th set of target grayscale value pairs | |
|---|---|---|---|---|
| value | BH1 | BL1 | BH2 | BL2 |
| 0 | 0 | 0 | 0 | 0 |
| 1 | 40 | 0 | 33 | 0 |
| 2 | 75 | 0 | 78 | 10 |
| 3 | 130 | 5 | 90 | 35 |
| 4 | 180 | 15 | 120 | 45 |
| 5 | 200 | 35 | 160 | 65 |
| . | . | . | . | . |
| . | . | . | . | . |
| . | . | . | . | . |
| 255 | 255 | 160 | 255 | 160 |

Also, the above is merely a specific example, and the range division of the grayscale value lookup tables and the respective grayscale value lookup tables are not limited to the implementations defined in the above embodiment.

S230, obtaining the corresponding two sets of target grayscale value pairs through utilizing the corresponding grayscale value lookup table, based on the average grayscale value of the blue sub-pixels in each pixel group.

As shown above, according to the obtained average grayscale value and the grayscale value lookup table, the corresponding two sets of target grayscale value pairs can be obtained by looking up the table.

S140, obtaining the corresponding two sets of driving voltage pairs according to the two sets of target grayscale value pairs in each pixel group.

There is a one-to-one correspondence between the driving voltage and the grayscale value, thus the corresponding driving voltage can be obtained according to the grayscale value. Therefore, the corresponding two sets of driving voltages (Bn'_H1 and Bn'_L1, Bn'_H2 and Bn'_L2) can be determined based on the two sets of target grayscale value pairs. In this embodiment, since there is a one-to-one correspondence between the driving voltage and the grayscale value, there are also a high driving voltage and a low driving voltage in the driving voltage pair. The driving voltage pair can be obtained by searching through the driving voltage lookup table. The driving voltage lookup table is a correspondence table between the color grayscale values in the input signals of the blue sub-pixels and the driving voltages. Specifically, each grayscale value of the blue sub-pixel corresponds to one driving voltage signal.

Figure 4:
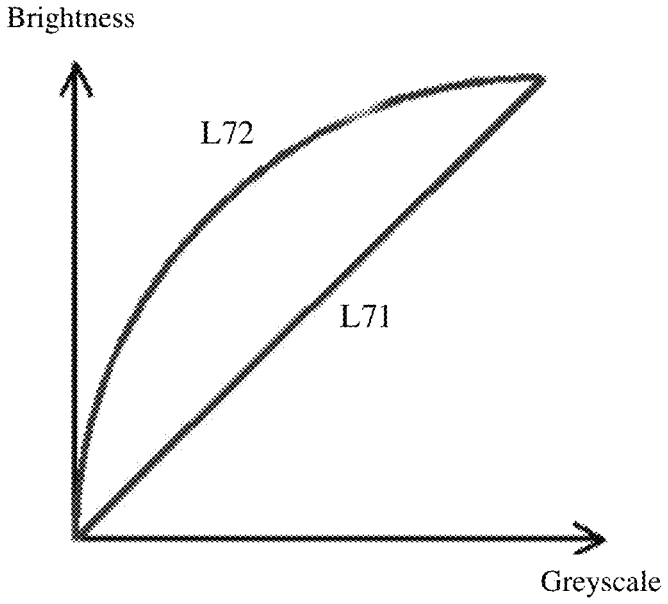
FIG. 4 is a comparison diagram illustrating the curves of brightness changing along with grayscale of the blue sub-pixels at a front viewing angle and at a side viewing angle when driven by a single driving voltage.

Each set of the high and low driving voltage pairs enables the curve of the brightness of the adjusted blue sub-pixels changing along with greyscale at the side view to be closer to the curve of the brightness at the front view changing along with greyscale. By driving the blue sub-pixels in each sub-pixel group by the high and low voltages, the brightness variation of the blue sub-pixels at the side view can be controlled, so that the saturation trend of the blue sub-pixels is close to the red sub-pixels and the blue sub-pixels or close to the brightness saturation curve trend of the red sub-pixels, the green sub-pixels and the blue sub-pixels at the front view, so as to reduce the defect of the viewing angle color shift. FIG. 4 is a diagram illustrating the curves of the brightness changing along with grayscale values of the blue sub-pixels at the front viewing angle and the side viewing angle when driven by a single driving voltage, in which L71 represents the curve at the front view and L72 represents the curve at the side view. Obviously, at the side view, the curve of the brightness changing along with the grayscale values would easily approach saturation, so that the image quality has an obvious defect of leaning towards blue at the mixed-color viewing angle. FIG. 5 is a comparison diagram illustrating the curves of the changing brightness at the side viewing angle when driven by the alternating high and low driving voltage pair, the high driving voltage, and the low driving voltage. Among them, L81 is the curve of brightness changing along with greyscale seen in the side viewing angle when driven by the high voltage, L82 is the curve of brightness changing along with greyscale seen in the side viewing angle when driven by the low voltage, and L83 is a mixture of L81 and L82, that is, the curve of brightness changing along with greyscale seen in the side viewing angle when driven by the alternating high and low voltage pair, and obviously it is closer to the curve L84 of the brightness changing along with greyscale at the front view, that is, using the alternating high and low driving voltage pair could improve the viewing angle color shift.

Since different driving voltages have different effects to different grayscale value ranges on improving the viewing angle color shift, so that one set of the two sets of driving voltage pairs necessarily corresponds to the high grayscale value, while the other corresponds to the low greyscale value. Therefore, in each pixel group there is one driving voltage pair capable of improving color shift for the high greyscale value at the large viewing angle and one driving voltage pair capable of improving color shift for the low greyscale value at the large viewing angle, so that from the low greyscale value to the high greyscale value, the brightness changing along with greyscale values of the blue sub-pixels could be close to the effect at the front viewing angle, effectively improving the defect of the color shift caused by the premature saturation of the blue sub-pixels at the large viewing angle.

S150, driving the blue sub-pixels in the corresponding pixel group according to the two sets of driving voltage pairs.

Specifically, during the driving process, the blue sub-pixels in the corresponding pixel group are respectively driven by the two sets of driving voltage pairs ($B_{n'_H1}$ and $B_{n'_H2}$ and $B_{n'_L2}$), so that one of the driving voltages of the adjacent two blue sub-pixels is high and the other is low, thereby improving the viewing angle color shift defect by alternating high and low voltage driving, as shown in FIG. 6.

In the above driving method of liquid crystal display panel, two sets of target grayscale value pairs are obtained according to the average grayscale value of each pixel group on the liquid crystal display panel. Each set of target grayscale value pairs includes a high and low grayscale value; the front viewing angle brightness of the mixed two is identical with that of the average grayscale value, so that the brightness would not be affected. The corresponding two sets of driving voltage pairs are obtained according to the two sets of target grayscale value pairs, so that there are two sets of driving voltage pairs which could improve the viewing angle color shift in each pixel group. Since different driving voltages have different effects to different grayscale value ranges on improving the viewing angle color shift, so that after mixing, from the low greyscale value to the high greyscale value, the brightness of the blue sub-pixels changing along with greyscale values could be close to the effect at the front viewing angle, effectively improving the defect of the color shift caused by the premature saturation of the blue sub-pixels at the large viewing angle. Moreover, after making use of the above driving method, the pixels of the liquid crystal display panel need not be designed as primary pixels and secondary pixels, thereby greatly improving the transmittance and resolution of TFT display panels, and reducing the backlight design cost.

The color shift improving effect of the driving method in this embodiment is further described below with reference to FIG. 7~9. Referring to FIG. 7, Target gamma is a curve of the brightness of the target blue sub-pixels changing along with grayscale values, corresponding to L61 in FIG. 7. Through the blue sub-pixel spatial division must satisfy that the RGB brightness ratio does not change at the front view. There are various combinations of high voltage and low voltage signals that are spatially divided by the blue sub-pixels, and the saturation situations of the side-view brightness changing along with the voltages caused by each combination are different. As shown in FIG. 7, the saturation situations of the side-view brightness changing along with the voltages caused by the high voltage combination gamma1 and the low voltage combination gamma2 spatially divided by the blue sub-pixels are different, which respectively correspond to L62 and L63 in FIG. 7. FIG. 8 and FIG. 9 are partial enlarged views of FIG. 7. As seen from FIG. 7~9, the blue sub-pixels on the display panel are driven by one set of high and low voltages, and the saturation trend of the curve of the brightness changing along with the voltages is much faster than that of the Target gamma. That is, the high voltage and low voltage combination by only one blue sub-pixel special division cannot meet the requirements of the brightness of high and low voltages being close to the target brightness.

As shown in FIG. 8, when considering the changing relationship between the low voltage (corresponding to the low grayscale value) and the brightness, the difference d1($n$) between the actual brightness of gamma1 and the target brightness is much greater than the difference d2($n$) between the actual brightness of gamma2 and the target brightness. However, as shown in FIG. 9, when considering the changing relationship between the high voltage and the brightness, the difference d1($n$) between the actual brightness of gamma 1 and the target brightness is much smaller than the difference d2($n$) between the actual brightness of gamma 2 and the target brightness. That is, gamma1 is suitable when the relatively high voltage signal of blue sub-pixels is present on the image (that is, the grayscale value of blue sub-pixels is relatively high). Otherwise, gamma2 is suitable when the relatively low voltage signal of blue sub-pixels is present on the image (that is, the grayscale value of blue sub-pixels is relatively low). In the driving method of this embodiment, each pixel group includes one driving voltage pair suitable for the high grayscale value and one driving voltage pair suitable for the low grayscale value, which makes the viewing angle brightness changing curve generated by the two sets of driving voltages combination combines the advantages of both, so that the viewing angle curve is closer to the requirements of the target value, and the curve changes smoothly, without abrupt change of color or abnormal color mixing. Gamma 3 (corresponding to L64 in FIG. 7~9) in FIG. 7~9 is a viewing angle brightness curve generated by using a combination of high and low voltages such as gamma 1 plus gamma 2. Obviously, the difference d3($n$) between the actual brightness of gamma 3 and the target brightness is always between d1($n$) and d2($n$), that is, the change is closer to the requirements of target value, so that the viewing angle color shift problem could be effectively improved.

Optionally, as shown in FIG. 12, in another embodiment the green sub-pixel is disposed along a lateral direction in the pixel 92, that is, along a row direction of the pixel group 90, that is, the long side of the green sub-pixel is parallel to the row direction. The red sub-pixel and the blue sub-pixel are both disposed along a longitudinal direction, that is, along the column direction of the pixel group 90, and the long side of the red sub-pixel and the long side of the blue sub-pixel are parallel to the column direction; and the long sides of the red sub-pixel and the blue the sub-pixels are adjacent to each other, and the long side of the green sub-pixel is adjacent to the short sides of the red sub-pixel and the blue sub-pixel. As seen from FIG. 12, the green sub-pixel is placed laterally above the red sub-pixel and the blue sub-pixel, thus reducing the lateral size of the pixel 92 and increasing the longitudinal size of the pixel unit, so that in the case where the total size of the liquid crystal display panel is constant, the number of pixels 92 in the lateral direction of the liquid crystal display panel could be increased, while reducing the number of pixels 92 in the longitudinal direction of the liquid crystal display panel.

Specifically, the aspect ratio b:a of each sub-pixel is less than 3:1, and optionally, the aspect ratio b:a=2:1. Compared with the typical pixel arrangements, the sub-pixel arrangement of the embodiment can improve the density of the pixels 92, thereby improving the resolution of the liquid crystal display panel.

The present disclosure also provides a liquid crystal display device as shown in FIG. 10. The liquid crystal display device could perform the above driving method. The liquid crystal display device includes a backlight component 310, a liquid crystal display panel 320, a control component 330, and a driving component 340. The control component 330 and the driving component 340 could be integrated on the liquid crystal display panel 310, and the backlight component 310 could be directly implemented by using a backlight module. It could be understood that the manner in which the various components are integrated is not limited thereto.

The backlight component 310 is configured to provide backlight. The backlight component 310 could be straight down type backlight or side light type backlight. The backlight may be white light, RGB three-color light source, RGBW four-color light source, or RGBY four-color light source, but is not limited thereto.

The liquid crystal display panel 320 could be a TN, OCB, or VA type TFT display panel, but is not limited thereto. The liquid crystal display panel 320 may be a liquid crystal display panel with a curved panel. In this embodiment, the pixels of the liquid crystal display panel 320 are divided into multiple pixel groups. Each pixel group includes an even number of pixels matrix arranged. In this embodiment, each pixel group includes four pixels matrix arranged, that is, it includes four blue sub-pixels matrix arranged, as shown in FIG. 2.

The control component 330 includes a computing unit 332, as shown in FIG. 11. The computing unit 332 is configured to receive an image input signal, and obtain an average grayscale value of the blue sub-pixels in each pixel group according to the image input signal. The computing unit 332 is further configured to obtain two sets of target grayscale value pairs according to the average grayscale value. Each set of target grayscale value pairs includes a high and low grayscale value. The front viewing angle brightness of the high and low grayscale value is the same as the front viewing angle brightness of the corresponding average grayscale value. The target grayscale value pairs could be obtained based on a grayscale value lookup table. Each grayscale value in the grayscale value lookup table corresponds to two sets of target grayscale value pairs. Therefore, according to the obtained average grayscale value, the corresponding two sets of target grayscale value pairs could be obtained by searching from the grayscale value lookup table. In one embodiment, a storage component 350 is also included. The storage component 350 is configured to store the grayscale value lookup table.

In one embodiment, the control component 330 further includes a determining unit 336. The determining unit 336 is configured to determine a grayscale range to which the average grayscale value of each pixel group belongs. An obtaining unit 334 is further configured to obtain a corresponding grayscale value lookup table according to the grayscale range, and obtain two sets of target grayscale value pairs by utilizing the corresponding grayscale value lookup table according to the two sets of target grayscale value pairs of each sub-pixel group. In this embodiment, the storage component 350 would store each grayscale range, the correspondence relationship between each grayscale range and the grayscale value lookup table, and the grayscale value lookup table corresponding to each grayscale range in advance. The obtaining unit 334 is further configured to obtain the corresponding two sets of driving voltage pairs according to the two sets of target grayscale value pairs in each pixel group.

The driving component 340 is respectively connected to the control component 330 and the liquid crystal display panel 320. The driving component 340 is configured to drive the blue sub-pixels in the corresponding pixel group according to the two sets of driving voltage pairs. Specifically, when performing driving, the driving component 340 controls one of the driving voltages of the adjacent two blue sub-pixels to be high, the other to be low, so that each pixel group is driven by the alternating high and low voltages.

In the above liquid crystal display device, two sets of target grayscale value pairs are obtained according to the average grayscale value of each pixel group on the liquid crystal display panel. Each set of target grayscale value pairs includes the high and low grayscale value, and the front viewing angle brightness of the mixed two is the same as the front viewing angle brightness of the average grayscale value, so that the brightness is not affected. The corresponding two sets of driving voltage pairs are obtained according to the target grayscale value pairs, so that each pixel group has two sets of driving voltage pairs that improve the viewing angle color shift. Since different driving voltage pairs have different effects to different grayscale value ranges on improving the viewing angle color shift, so that after mixing from the low greyscale value to the high greyscale value, the change of the brightness of the blue sub-pixels along with the greyscale values could be close to the effect of the front viewing angle, effectively improving the defect of color shift caused by premature saturation of the blue sub-pixels at the large viewing angle.

Optionally, as shown in FIG. 12, in another embodiment the green sub-pixel is disposed along the lateral direction in the pixel 92, that is, along the row direction of the pixel group 90, that is, the long side of the green sub-pixel is parallel to the row direction. The red sub-pixel and the blue sub-pixel are both disposed along the longitudinal direction, that is, along the column direction of the pixel group 90, and the long side of the red sub-pixel and the long side of the blue sub-pixel are parallel to the column direction; and the long sides of the red sub-pixel and the blue sub-pixel are adjacent to each other, and the long side of the green sub-pixel is adjacent to the red sub-pixel and the short side of the blue sub-pixel. As shown in FIG. 12, the green sub-pixel is placed laterally above the red sub-pixel and the blue sub-pixel, which reduces the lateral size of the pixel 92 and increases the longitudinal size of the pixel unit, so that in the case of the total size of the liquid crystal display panel being constant, which could increase the number of pixels 92 along the lateral direction on the liquid crystal display pane, while decrease the number of pixels 92 along the longitudinal direction on the liquid crystal display panel.

Specifically, the aspect ratio b:a of each sub-pixel is less than 3:1, and optionally, the aspect ratio b:a=2:1. Compared with the typical pixel arrangements, the sub-pixel arrangement of this embodiment could improve the density of the pixels 92, thereby improving the resolution of the liquid crystal display panel.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this description.

The foregoing description portrays merely some illustrative embodiments of the present disclosure, and the description thereof is relatively specific and detailed, and are not intended to limit the patentable scope of the present disclosure. It should be noted that any variation and improvement may be made by those skilled in the art without departing from the conception of the present disclosure, shall all fall within the protection scope of the present disclosure. Therefore, the protection scope of the present disclosure should be determined by the appended claims.

What is claimed is:

1. A driving method of liquid crystal display panel, comprising:

dividing the pixels of the liquid crystal display panel into multiple pixel groups; each pixel group comprising an even number of pixels matrix arranged, the pixels comprising a red sub-pixel, a green sub-pixel, and a blue sub-pixel adjacent to each other, and the red sub-pixel, the green sub-pixel, and the blue sub-pixel being all rectangular;

wherein, the method further comprises:

obtaining an average grayscale value of the blue sub-pixels in each sub-pixel group based on an image input signal;

obtaining two sets of target grayscale value pairs based on the average grayscale value; each set of target grayscale value pairs comprising a high and low grayscale value; the front viewing angle brightness of the high and low grayscale value is identical with that of the average grayscale value;

obtaining the corresponding two sets of driving voltage pairs according to the two sets of target grayscale value pairs in each pixel group; and driving the blue sub-pixels in the corresponding pixel group according to the two sets of driving voltage pairs;

wherein, the green sub-pixel is disposed along a lateral direction; the red sub-pixel and the blue sub-pixel are both disposed along a longitudinal direction, and their long sides are adjacent; a long side of the green sub-pixel is adjacent with short sides of the red sub-pixel and the blue sub-pixel, the green sub-pixel is placed laterally above the red sub-pixel and the blue sub-pixel;

wherein, in the step of obtaining two sets of target grayscale value pairs based on the average grayscale value, the two sets of target grayscale value pairs are obtained by searching from a grayscale value lookup table; each grayscale value in the grayscale value lookup table corresponds to two sets of target grayscale value pairs, the two sets of target grayscale value pairs have different improving ranges on viewing angle color shift;

the step of obtaining two sets of target grayscale value pairs based on the average grayscale value comprises: determining a grayscale range to which the average grayscale value of the blue sub-pixels in each pixel group belongs; obtaining the corresponding grayscale value lookup table according to the grayscale range of each pixel group; and obtaining the corresponding two sets of target grayscale value pairs through utilizing the corresponding grayscale value lookup table, based on the average grayscale value of the blue sub-pixels in each pixel group;

in the step of driving the blue sub-pixels in the corresponding pixel group according to the two sets of driving voltage pairs, one of the driving voltages of two adjacent blue sub-pixels being high and the other being low.

2. A driving method of liquid crystal display panel, comprising:

dividing the pixels of the liquid crystal display panel into multiple pixel groups; each pixel group comprising an even number of pixels matrix arranged, the pixels comprising a red sub-pixel, a green sub-pixel, and a blue sub-pixel adjacent to each other, and the red sub-pixel, the green sub-pixel, and the blue sub-pixel being all rectangular;

wherein, the method further comprises:

obtaining an average grayscale value of the blue sub-pixels in each sub-pixel group based on an image input signal;

obtaining two sets of target grayscale value pairs based on the average grayscale value; each set of target grayscale value pairs comprising a high and low grayscale value; the front viewing angle brightness of the high and low grayscale value is identical with that of the average grayscale value;

obtaining the corresponding two sets of driving voltage pairs according to the two sets of target grayscale value pairs in each pixel group; and, driving the blue sub-pixels in the corresponding pixel group according to the two sets of driving voltage pairs;

wherein, the green sub-pixel is disposed along a lateral direction; the red sub-pixel and the blue sub-pixel are both disposed along a longitudinal direction, and their long sides are adjacent; a long side of the green sub-pixel is adjacent with short sides of the red sub-pixel and the blue sub-pixel.

3. The method of claim 2, wherein, in the step of obtaining two sets of target grayscale value pairs based on the average grayscale value, the two sets of target grayscale value pairs are obtained by searching from a grayscale value lookup table; each grayscale value in the grayscale value lookup table corresponds to two sets of target grayscale value pairs.

4. The method of claim 3, wherein, in the step of driving the blue sub-pixels in the corresponding pixel group according to the two sets of driving voltage pairs, one of the driving voltages of two adjacent blue sub-pixels being high and the other being low.

5. The method of claim 3, wherein each of the red, green, and blue sub-pixel has an aspect ratio of less than 3:1.

6. The method of claim 5, wherein each of the red, green, and blue sub-pixel has an aspect ratio equal to 2:1.

7. The method of claim 3, wherein the step of obtaining two sets of target grayscale value pairs based on the average grayscale value comprises:

determining a grayscale range to which the average grayscale value of the blue sub-pixels in each pixel group belongs;

obtaining the corresponding grayscale value lookup table according to the grayscale range of each pixel group; and, obtaining the corresponding two sets of target grayscale value pairs through utilizing the corresponding grayscale value lookup table, based on the average grayscale value of the blue sub-pixels in each pixel group.

8. The method of claim 3, further comprising a step of pre-storing the grayscale value lookup table.

9. The method of claim 2, wherein, in the step of driving the blue sub-pixels in the corresponding pixel group according to the two sets of driving voltage pairs, one of the driving voltages of two adjacent blue sub-pixels is high and the other is low.

10. The method of claim 2, wherein each of the red, green, and blue sub-pixel has an aspect ratio of less than 3:1.

11. The method of claim 10, wherein each of the red, green, and blue sub-pixel has an aspect ratio equal to 2:1.

12. A liquid crystal display device, comprising:

a backlight component;

a liquid crystal display panel, on which the pixels are divided into multiple pixel groups; each pixel group comprising an even number of pixels matrix arranged, the pixels comprising a red sub-pixel, a green sub-pixel, and a blue sub-pixel adjacent to each other, and the red sub-pixel, the green sub-pixel, and the blue sub-pixel all being rectangular;

wherein, the liquid crystal display device further comprises:

a control component, comprising a computing unit and an obtaining unit; the computing unit being configured to receive an image input signal, and obtain an average grayscale value of the blue sub-pixels in each sub-pixel group based on the image input signal; the computing unit further being configured to obtain two sets of target grayscale value pairs based on the average grayscale value; each set of target grayscale value pairs comprising a high and low grayscale value; the front viewing angle brightness of the high and low grayscale value being identical with that of the average grayscale value; the obtaining unit being configured to obtain corresponding two sets of driving voltage pairs according to the two sets of target grayscale value pairs in each pixel group; and a driving component, respectively connected to the control component and the liquid crystal display panel; the driving component being configured to drive the blue sub-pixels in the corresponding pixel group according to the two sets of driving voltage pairs;

wherein, the green sub-pixel is disposed along a lateral direction; the red sub-pixel and the blue sub-pixel are both disposed along a longitudinal direction, and their long sides are adjacent; a long side of the green sub-pixel is adjacent with short sides of the red sub-pixel and the blue sub-pixel.

13. The device of claim 12, wherein, the obtaining unit is configured to obtain corresponding two sets of target grayscale value pairs by searching from a grayscale value lookup table based on the average grayscale value; each grayscale value in the grayscale value lookup table corresponds to two sets of target grayscale value pairs.

14. The device of claim 13, wherein, when the driving component drives the blue sub-pixels in the corresponding pixel group according to the two sets of driving voltage pairs, one of the driving voltages of two adjacent blue sub-pixels is controlled to be high and the other to be low.

15. The device of claim 13, wherein, each of the red, green, and blue sub-pixel has an aspect ratio of less than 3:1.

16. The device of claim 13, wherein, the control component further comprises a determining unit; the determining unit is configured to determine a grayscale range to which the average grayscale value of the blue sub-pixels in each pixel group belongs; the obtaining unit is configured to obtain the corresponding grayscale value lookup table according to the grayscale range of each pixel group, and obtain the corresponding two sets of target grayscale value pairs through utilizing the corresponding grayscale value lookup table, based on the average grayscale value of the blue sub-pixels in each pixel group.

17. The device of claim 13, further comprising:

a storage component, configured to store the grayscale value lookup table.

18. The device of claim 13, wherein, each of the red, green, and blue sub-pixel has an aspect ratio of less than 3:1.

19. The device of claim 18, wherein, each of the red, green, and blue sub-pixel has an aspect ratio equal to 2:1.

20. The device of claim 12, wherein, when the driving component drives the blue sub-pixels in the corresponding pixel group according to the two sets of driving voltage pairs, one of the driving voltages of two adjacent blue sub-pixels is controlled to be high and the other to be low.

* * * * *